United States Patent [19]

Kato

[11] 4,190,134

[45] Feb. 26, 1980

[54] DISH CARRYING SYSTEM

[76] Inventor: Noboru Kato, 1279 banchi Josuihoncho, Kodaira-shi, Tokyo, Japan

[21] Appl. No.: 862,608

[22] Filed: Dec. 20, 1977

[30] Foreign Application Priority Data

Apr. 14, 1977 [JP] Japan ..... 52/43291
Apr. 14, 1977 [JP] Japan ..... 52/43292

[51] Int. Cl.[2] ..... A47G 23/08
[52] U.S. Cl. ..... 186/1 R
[58] Field of Search ..... 186/1 R, 1 B, 1 C, 1 D, 186/1 AF, 1 AB, 1 AH, 1 AR, 1 AJ, 1 AT, 1 AK, 1 AS, 1 AL; 104/88; 105/328, 373, 327; 214/83.24; 414/522

[56] References Cited

U.S. PATENT DOCUMENTS

| | | | |
|---|---|---|---|
| 1,377,813 | 5/1921 | Dlugach | 186/1 R X |
| 3,016,456 | 1/1962 | Corporon | 104/88 |
| 3,399,489 | 9/1968 | Rogers | 46/202 |
| 3,464,363 | 9/1969 | Wishart | 186/1 R X |

FOREIGN PATENT DOCUMENTS

| | | | |
|---|---|---|---|
| 5139940 | 4/1976 | Japan | 186/1 R |

*Primary Examiner*—Albert J. Makay
*Assistant Examiner*—Edmond G. Rishell, Jr.
*Attorney, Agent, or Firm*—Frishauf, Holtz, Goodman & Woodward

[57] ABSTRACT

Rails are laid out between a kitchen or food preparation area and a dining room in a restaurant and a number of tables are arranged along and on opposite sides of the rails. At least one vehicle for carrying food and pulled by a model locomotive runs on the rails to convey food prepared in the kitchen or food preparation area to a specific one or ones of the tables. Travel of the dish carrier on the rails is controlled by a control device installed in the kitchen or food preparation area. The food carrying vehicle has doors which are operable from both sides thereof to permit access from both sides of the rails, and the doors are preferably interlocked with a slidable tray in the vehicle to cause the tray to automatically slide at least partially out of the vehicle upon opening of a door.

11 Claims, 6 Drawing Figures

DISH CARRYING SYSTEM

BACKGROUND OF THE INVENTION

The present invention relates to systems for carrying food and/or drink from one position to another and, more particularly, to a food carrying system for conveying cooked food from a cuisine, kitchen or preparation area (hereinafter referred to simply as a kitchen) to selected tables in a restaurant by means of a food carrying vehicle drawn by a model locomotive travelling on a track laid out between the kitchen and the tables.

A food carrying system of the type described has already been proposed by us as disclosed in the Specification of unexamined Japanese Patent Publication No. 51-39940 (1976) and in practical use for the purpose of saving labor necessary and for speeding up conveyance of food and drink in restaurants. In this prior system, a vehicle for carrying slips or orders runs on a track laid out from a cashier's counter to a kitchen while a vehicle loaded with food travels on another track extending between the kitchen and in front of a series of tables. A diner will thus take food out of the food carrier from one side thereof when the food carrier reaches a position in front of the diner's table. A drawback is encountered in this type of system, however, in that it is unsuited for coping with a large number of diners since the number of tables which a single food carrier can handle is limited. A food carrier used for the purpose described above should preferably be provided with a shutter or a flap to cover an opening, which is formed through one side wall of the vehicle body, with a view to avoiding deposition of dust and other alien substances on dishes during travel of the food carrier. Here arises another drawback in that, since the prior art food carrier has a shutter or a flap on only one of its laterally opposite sides, tables must be arranged on one side of the track for access to the shutter or flap, resulting in a limitation on the number of installable tables.

An object of the present invention is to provide a food carrying system which conveys food to a number of tables efficiently and with the simplest installation.

Another object of the present invention is to provide a food carrying vehicle which, when a flap of the vehicle is opened, permits a tray member to slide toward the flap for facilitating easy removal of food from the tray member.

Still another object of the present invention is to provide a food carrying vehicle in which, when one of two flaps is opened, means for interlocking the other flap with a tray member does not interfere with the opening action of said one flap.

SUMMARY OF THE INVENTION

According to the present invention, there is provided a conveying system comprising a track extending between a first area such as a restaurant kitchen and a plurality of second locations such as a plurality of tables. The plurality of second locations are arranged on laterally opposite sides of the track on which a carrier travels for carrying a product (e.g. food, drink) from the first area (e.g. the kitchen) to a second location (e.g. a table). The carrier is pulled by a model locomotive and its movement is controlled by control means disposed in the first area. A plurality of position-detecting switches are disposed on the track in correspondence with respective second location (e.g. tables).

In a preferred arrangement, another track extends from a cashier's counter located in the vicinity of an entrance of a restaurant to the food preparation area. A miniature vehicle runs on this track to carry a slip or order to the food preparation area.

The carrier preferably has openings on laterally opposite sides thereof, openable flaps closing the respective openings and a tray member slidable horizontally in interlocked relation with said flaps. The carrier also preferably comprises means for detecting the positions of the flaps.

DETAILED DESCRIPTION OF ILLUSTRATED EMBODIMENT

Figure 1:
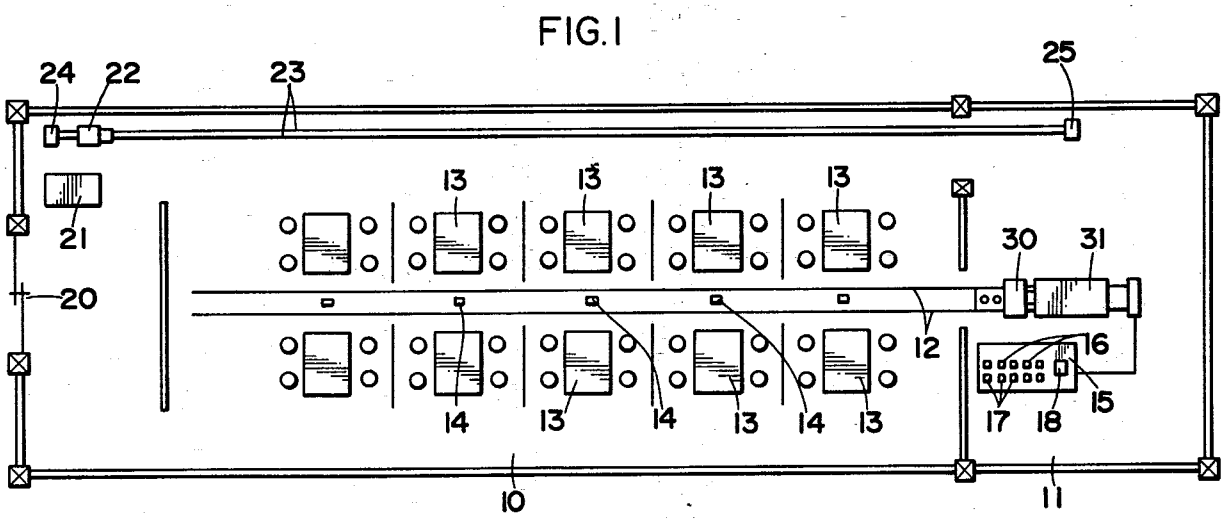
FIG. 1 is a plan view schematically showing a restaurant embodying a food carrying system according to the present invention.
Figure 2:
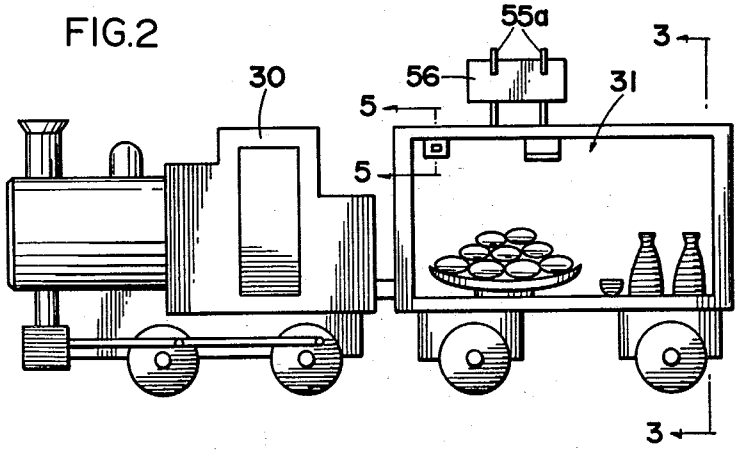
FIG. 2 is a schematic view of a food carrying vehicle for use in the system of the present invention.

Referring to FIG. 1, the interior of a restaurant employing a dish carrying system of the present invention is generally partitioned into a first section or dining room 10 and a second section or cuisine, kitchen or food preparation area 11. A number of tables 13 are arranged on opposite sides of rails 12 which are laid out substantially in the central part of the interior of the restaurant. A model locomotive 30 and a dish carrier 31 pulled by the model locomotive are capable of running on the rails 12 so as to convey cooked food prepared in the kitchen 11. The locomotive 30 has a drive motor installed therein and is driven by a current selectively fed to the rails 12. A series of position detecting switches 14 are disposed between and along the rails 12 so that the dish carrier 31 may be stopped in a position on the rails corresponding to selected ones of the tables 13. A control panel 15 for controlling the movement of the dish carrier 31 is located in the kitchen 11. The control panel 15 carriers thereon a set of push buttons 16 for permitting the dish carrier 31 to move forwards as far as any desired one of the tables 13, another set of push buttons 17 for moving the dish carrier 31 backwards from any one of the tables 13 and a timer 18 for causing the halted dish carrier 31 to stay at an intended one of the tables 13 for a preset period of time. The timer 18 may be installed in the model locomotive 30 instead of the control panel 15. When any one of the push buttons 16 is depressed, the dish carrier will advance to the corresponding table until it is stopped by the corresponding position detecting switch 14 and, after a halt of a time period preset in the timer 18, it will make another forward movement.

Rails 23 run at one side of the interior of the restaurant from a cashier's counter 21 located in the vicinity of an entrance 20 to the kitchen 11 while a miniature vehicle 22 travels on the rails 23 to thereby carry a slip from the counter 21 to the kitchen 11. The slip carrier 22 has its movement on the rails 23 controlled by switches 24 and 25 located in positions to which a cashier and a cook are accessible, respectively.

Turning now to FIGS. 2, 3*a*, 3*b* and 4, the dish carrier 31 is shown as having a body having openings 32*a* and 32*b* on both sides thereof for loading and unloading of dishes and to permit a diner at any one of the tables 13 on either side of the rails 12 to readily take dishes out of the carrier from the side closest to him or her. Entry of particles of dust and other undesirable contaminants from a sanitary point of view into the dish carrier is avoided by flaps or lids 35*a* and 35*b* which are provided to selectively open and close the openings 32*a* and 32*b*, respectively, and which are swingable about respective pivots 34*a* and 34*b* supported on a base 33. Handles 36*a* and 36*b* are mounted on lids 35*a* and 35*b*, respectively, for facilitating opening and closing of the lids 35*a* and 35*b*. Support plates 38*a* and 38*b* (FIG. 4), each carrying rotatable rollers 37*a*, 37*b*, 37*c* and 37*d* thereon, are securely mounted on opposite ends of the base 33. Grooved plates 40 are fixedly mounted on opposite end faces of a tray member 39 which is adapted to be loaded with dishes. The elongated groove of each plate 40 is engaged with the rollers 37*a*–37*d* to thereby permit sliding movement of the tray member 39 on the rollers.

Figure 3A:
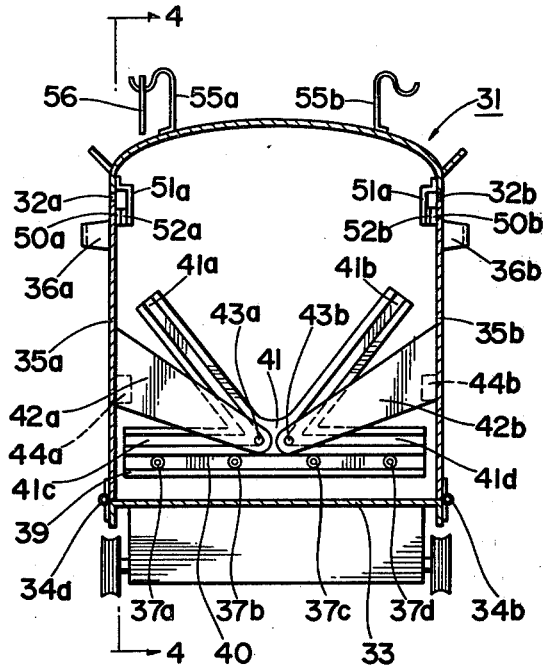
FIG. 3*a* is a section taken on line 3—3 of FIG. 2 and shows one state wherein the flaps of the food carrying vehicle are closed.

Secured to at least one end of the tray member 39 is a guide plate 41 formed with a generally V-shaped slot portion having two disconnected inclined slots, 41*a* and 41*b* and horizontal slots 41*c* and 41*d* contiguous with the slots 41*a* and 41*b*, respectively, at the converging ends of the latter. Thus, the slots 41*a* and 41*c* communicate with each other and likewise the slots 41*b* and 41*d* communicate with each other. The slots 41*a* and 41*c* do not communicate with respective slots 41*b* and 41*d*. Slidably engaged in the slots 41*a*–41*d* are pins 43*a* and 43*b* which extend from extreme ends of arms 42*a* and 42*b*, respectively, the other ends of the arms 42*a* and 42*b* being secured to the respective lids 35*a* and 35*b*. While the lids 35*a* and 35*b* are closed as shown in FIG. 3*a*, the pin 43*a* is located at a position where the slots 41*a* and 41*c* converge or meet, whereas the pin 43*b* is positioned at the converging or meeting point of the slots 41*b* and 41*d*. Stops 44*a* and 44*b* are fixed to base portions of the arms 42*a* and 42*b*, respectively, to limit the sliding movement of the tray 39. In the preferred illustrated embodiment, guide plates 41 are provided at both ends of the carrier 31, and the lids each have arms 42*a*, 42*b* at both ends thereof, as shown, for example, in FIG. 4.

Figure 5:
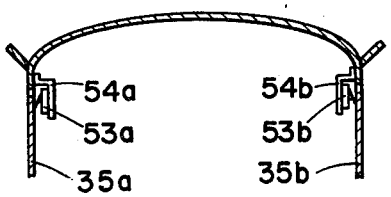
FIG. 5 is a section taken on line 5—5 of FIG. 2.

Magnets 50*a* and 50*b* are mounted to the upper ends of the inner surfaces of the respective lids 35*a* and 35*b* while plates 52*a* and 52*b* of such a magnetic material as iron are secured to support plates 51*a* and 51*b*, respectively, which are in turn mounted to upper portions of the vehicle body in correspondence with the magnets 50*a* and 50*b*. Also mounted to upper portions of the body of the dish carrier 31, as seen in FIG. 5, are support plates 54*a* and 54*b* which carry thereon microswitches 53*a* and 53*b* which are operative responsive to opening and closing of the corresponding lids 35*a* and 35*b*. The lids engage their respective microswitch when they are closed, the switches being arranged such that current supply to the drive for pulling the dish carrier 31 is interrupted when the lid 35*a* or 35*b* is opened. Upon closing of the lid 35*a* and 35*b*, the microswitch 53*a* or 53*b*, respectively, causes electrical current to be fed to the drive for pulling the food carrier.

Figure 3B:
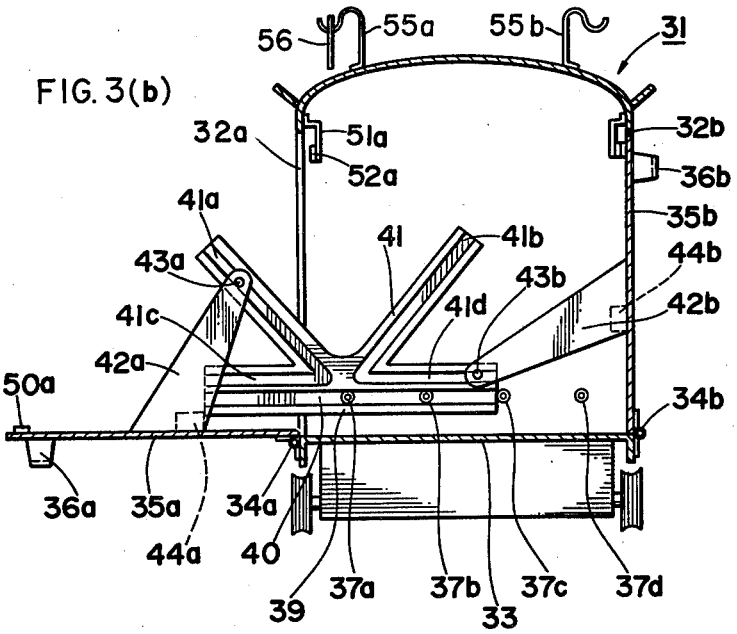
FIG. 3*b* is a view similar to FIG. 3*a* but showing the other state wherein one of the flaps is opened.
Figure 4:
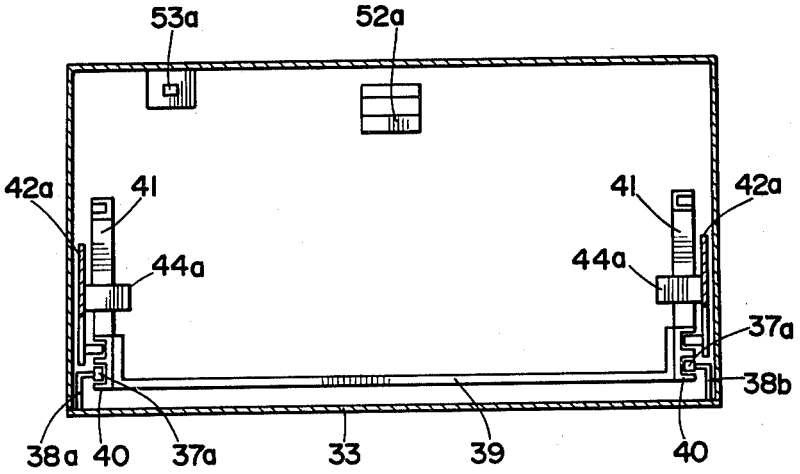
FIG. 4 is a section taken on line 4—4 of FIG. 3*a*.

As seen in FIGS. 3*a* and 3*b*, hooks 55*a* and 55*b* are mounted on the roof of the dish carrier 31. A plate or other indicia carrying member 56 marked with a destination, which may be the name or the number of an intended one of the tables, will be hung on either one of the hooks.

The above-described dish carrying system of the present invention operates as follows:

As a person orders a dish or dishes at the counter 21, a service worker at the counter prepares a slip with the order marked thereon, loads the slip on the miniature vehicle 22 and operates the switch 24 to cause the miniature vehicle 22 with the slip loaded thereon to travel on the rails 23 to carry the slip to the kitchen 11. In the kitchen 11, dishes are prepared according to the content of the slip and are loaded on the dish carrier 31. Concurrently, the destination plate 56 is hung on the hook 55*a* or 55*b*. Thereupon, one push button 16 (to cause forward travel of the train) and one push button 17 (to cause reverse travel), both corresponding to a table 13 which the diner has occupied, are depressed. Depression of the push button 16 feeds electrical current to the rails 12 to cause the model locomotive 30 to pull the dish carrier 31 on the rails 12 as far as the intended table 13. Upon arrival of the locomotive, one of the switches 14 corresponding to said table 13 is actuated to interrupt the current supply to the rails 12 whereby the dish carrier is brought to a halt at the table 13 specified by the depressed push button 16.

The diner, after looking at the mark carried on the destination plate 56 for confirming the destination of the dishes, grips the handle 36*a* and pulls the lid 35*a* toward him or her. As the lid 35*a* is thus opened, the lid 35*a*, with arm 42*a* integral therewith, swivels about the pivot 34*a*. Accordingly, the pin 43*a* carried on the arm 42*a* slides along the slot 41*a* while defining an arcuate locus whereby the guide plate 41 and the tray member 39 integrally connected with the guide plate 41 are moved together toward the opening 32*a* of the carrier body. The tray member 39 slides on rollers 37 relative to the base 33 and then rides over the inner lower surface portion of the lid 35*a* until it abuts against the stop 44*a* and then comes to a halt. The stop 44*a*, in combination with the arm 42*a* and guide plate 41, restrains the lid 35*a* from moving any further about pivot 34*a*. The other lid 35*b*, though remaining closed, does not interfere with the sliding movement of the tray member 39 toward the opening 32*a* since the pin 43*b* on the free end of the arm 42*b* is caused to slide along the horizontal slot 41*d* in guide plate 41.

As the lid 35*a* is opened in this way, the tray 39 is pulled automatically out of the dish carrier 31 by a distance which is slightly less than one half of the width of the tray 39, as seen in FIG. 3*b*. Consequently, the diner may quite easily take the dishes out of the carrier 31. When the diner again closes the lid 35*a* after unloading all of the dishes from the dish carrier 31, the tray member 39 is caused to slidingly return to its original or home position. It will readily be understood that the other lid 35*b* can be opened in exactly the same way as the lid 35*a*.

As long as the lid 35*a* is kept opened, the dish carrier 31 remains at a standstill even if the time period preset in the timer 18 lapses to establish current supply to the rails 12, because the microswitch 53*a* corresponding to the lid 35*a* holds the carrier 31 in the "OFF" state. When the diner closes the lid 35*a* after taking out the dishes, the microswitch 53*a* is actuated to the "ON" state by engagement with the closed lid 35*a* to start the movement of the dish carrier 31. In the case where the table 13 specified by the depressed push button 17 for reverse movement is the one positioned ahead the table mentioned hereinabove, the carrier 31 will make another distance of forward travel to the table 13 corresponding to the selected push botton 17 and, by the action of the switch 14 relevant to said table, come to a standstill which lasts for the period of time preset by the timer 18. After the time period of timer 18 lapses, an electrical current of the opposite polarity is supplied to the rails 12 (as directed by the prior depression of push button 17), and the dish carrier 31 will travel backward into the kitchen 11, thereby terminating all the procedures for conveying dishes.

It is to be noted that, while the model locomotive has been shown and described as having a single dish carrier 31, two or more similar dish carriers 31 may be included in the formation of a train with a view to transporting food to a plurality of tables 13 with one round-trip of the train. The efficiency of transportation will be further improved in this case if the dish carriers pulled by a single locomotive deliver dishes to specific tables in sequence and travels backwards thereafter. This may be accomplished by depressing all the push buttons for forward travel corresponding to the intended tables and one of the push buttons 17 for reverse travel which corresponds to the farthest one of the intended tables from the kitchen or which corresponds to the last one of the tables arranged in the dining room.

In an alternative structure, each dish carrier of the system may have their lids removed from the openings. In that case, when the dish carrier stops at a particular table, a statement urging a diner at said table to take out dishes within a certain period of time may be given from a speaker for example provided at the table and, upon the lapse of the predetermined time, a timer will be actuated to drive the dish carrier backwardly.

Furthermore, two or more pairs of rails may be provided for carrying dishes instead of a single pair shown and described. Moreover, the rails need not run linearly, but may run in any other desired way, e.g. a U-shaped or semi-circular shaped run.

As will now be appreciated from the foregoing description, a food carrying system according to the present invention has the following advantages:

(1) A single vehicle sufficies to carry dishes and drinks to a number of dining tables since the tables are arranged on opposite sides of rails;

(2) Transportation of food is effected with desirable efficiency to diners at the tables because the dish carrier has openings and openable lids for closing the openings on laterally opposite sides thereof;

(3) A tray member can protrude outwardly through either opening mentioned above in interlocked relation with the corresponding lid, thereby facilitating manipulation by a diner for taking out dishes brought to him or her; and (4) A simple structure for a dish carrier is realized wherein, when the tray member protrudes in accordance with opening of one lid, means for interlocking the tray member with the other lid does not interfere with the action of the tray member at all.

I claim:

1. Apparatus for carrying a product from a first area to a preselected one of a plurality of second locations, comprising:

rails laid over the distance between said first area and said plurality of second locations, said plurality of second locations being arranged along and on laterally opposite sides of said rails; and a vehicle adapted to travel on said rails with a product loaded thereon, said vehicle including:

a body mounted on wheels which are engageable with said rails;

openings on laterally opposite sides of said body;

flaps movably mounted on said body for selectively opening and closing respective ones of said openings; and a tray member in said body and slidable horizontally relative to said body and in interlocked relation with opening and closing actions of each of said flaps, said tray member being slidable outwardly of said body toward one of said openings when the flap corresponding to said one of said openings is opened and being slideable inwardly to its original position in said body upon closing of said corresponding flap.

2. The system of claim 1, wherein said first area is a kitchen or food preparation area of a restaurant, and said plurality of said second locations comprises a plurality of tables arranged in a dining area, said tables being arranged along and on laterally opposite sides of said rails.

3. The system of claim 1, wherein:

said flaps are pivotally mounted to said body at a lower portion thereof and in registration with their respective openings;

said tray member comprises a guide plate mounted at at least one end thereof, said guide plate having inclined grooves extending toward the sides of the said body and inclined downwardly toward the center of the tray; and means coupling said flaps with respective grooves of said guide plate for interlocking said flaps with said tray member.

4. The system of claim 3, wherein said means coupling said flaps to said guide plate comprise respective arms fixedly connected to said flaps at one end of said arms, and means at the other ends of said respective arms for slideably engaging said respective inclined grooves of said guide plate.

5. The system of claim 4, wherein said flaps comprise a stop member thereon for engaging said tray to halt the movement of said tray out of said body and to halt the opening action of said flap upon engagement of said tray with said stop member.

6. The system of claim 4, wherein said guide plate further comprises a substantially horizontally extending groove in communication with respective ones of said inclined grooves for slideably receiving the end of the arm of the flap which is not opened during opening of another of said flaps, thereby preventing a closed flap from interfering with movement of said tray.

7. The system of claim 1, wherein said body comprises means for detecting the opened and closed positions of said flaps.

8. The system of claim 7, comprising means coupled to said detecting means for inhibiting movement of said vehicle when a flap is opened.

9. The system of claim 2, wherein said vehicle comprises means for carrying an indicia corresponding to a table to which the product is to be carried.

10. The system of claim 9, wherein said body has a roof and said indicia carrying means comprises a plate, and means mounted to the roof of said body for carrying said plate with said indicia exposed for viewing.

11. The system of claim 1, wherein said vehicle comprises a locomotive coupled to said body mounted on wheels for pulling said body on said rails.

* * * * *